US005265309A

United States Patent [19]

Oille

[11] Patent Number: 5,265,309

[45] Date of Patent: Nov. 30, 1993

[54] SHOWER DOOR AND HINGE

[75] Inventor: Fred J. Oille, Mississagua, Canada

[73] Assignee: Waterline Products Co. Ltd., Rexdale, Canada

[21] Appl. No.: 837,125

[22] Filed: Feb. 19, 1992

[51] Int. Cl.[5] ..... E05D 7/10; E05D 5/06; A47K 3/22

[52] U.S. Cl. ..... 16/262; 16/379; 16/390; 4/610

[58] Field of Search ..... 16/379, 262, 390; 4/607, 610

[56] References Cited

U.S. PATENT DOCUMENTS 2,608,714 9/1952 Howard ..... 16/262

FOREIGN PATENT DOCUMENTS 2160257 12/1985 United Kingdom ..... 16/262

*Primary Examiner*—John Sipos

*Assistant Examiner*—Carmine Cuda

*Attorney, Agent, or Firm*—Kenneth M. Garrett

[57] ABSTRACT

A hinge assembly comprises a pair of continuous extruded channel members, one of which has an axially aligned tubular portion and the other an axially aligned keyway. The members are united by hinge clips having a leg insertable in the keyway and a gudgeon plate having an opening depending from the leg, and a hinge pin which passes through the gudgeon plate opening and the tubular portion. The keyway may be hidden within the other member, which may be transversely slotted to provide an access opening for the leg where this is to be supported intermediate the axial ends of the member. Similarly the tubular member may be transversely slotted to provide an access opening for the gudgeon plate. The other member may include one or more axially aligned extensions which form a labyrinth seal with the one member, making the hinge assembly particularly suited for use in shower doors.

20 Claims, 2 Drawing Sheets

SHOWER DOOR AND HINGE

FIELD OF INVENTION

This invention relates to improvements to hinges. It further relates to hinges for joining panels, and has particular application to door assemblies for shower enclosures, although it is not necessarily limited thereto.

BACKGROUND OF INVENTION

In U.S. Pat. No. Des. 318,524, commonly assigned herewith there is illustrated a shower door which comprises a plurality of panels joined together by hinges which are supported by brackets secured to the planar surface of the panel. One of the disadvantages of this construction is the difficulty of sealing the bracket-panel interface.

In U.S. application Ser. No. 622,583, now U.S. Pat. No. 5,097,543, commonly assigned herewith the contents of which are incorporated by reference thereto, there is described a modified shower door hinge structure which connects to the vertical edges of the panels. The hinge components are suitably formed as extrusions, and the knuckles of the hinges are formed by cutting away tubular segments of the extrusions at intervals. Separate sealing strips were provided to reduce leakage of water across the hinge. Although the manufacture of this type of hinge and shower door is amenable to automation, the manufacture of the hinge elements is relatively slow.

Shower door enclosures for baths typically require at least three panels joined together by two hinges. In order to make the assembly fold flat, one of the hinges has its axis normally in the plane of the panels when they are coplanar, which type of hinge is referred to in the specification as an in-line hinge, and the other hinge has its axis off-set from the plane, which type of hinge is referred to as an off-set hinge. The in-line and off-set hinges of these other shower door assemblies have no common major component, excluding the hinge pin, thereby adding to the manufacturing cost. Since the door assemblies themselves are handed, the left and right hand off-set hinges may also differ.

It is convenient for packaging, installation and the maintenance of shower door enclosures to provide a means for the panels of the enclosures to be joined together or separated one from the other in situ. Where a long, continuous hinge pin is used this is usually impossible, as the clearance above the doors when installed is usually less than the length of the hinge pin.

It is an object of this invention to provide a novel hinge assembly.

It is another object of this invention to provide a hinge assembly that is particularly suited for use in connecting the panels of a shower door enclosure together.

It is a further object of this invention to provide a hinge assembly that may be made from extruded sections without necessitating specialized equipment, if at all.

It is a still further object of this invention to provide planar or off-set hinge assemblies having a common major component.

It is another object of this invention to provide hinge assemblies that are self-sealing to reduce the passage of water thereacross.

It is yet another object of this invention to provide shower doors that are particularly suited for partial assembly and disassembly in situ.

SUMMARY OF INVENTION

In accordance with one object of this invention, a hinge assembly for joining two panels together in hinged relationship comprises first and second axially elongated members each having a substantially constant cross-section therealong. The members are both defined by axially aligned wall structure including a pair of spaced apart side walls interconnected by a bight, together forming a forwardly open channel into which an edge of the panel is receivable.

The wall structure of the first member further includes an axially aligned tube supported from the channelar forming wall structure. An internal, axially aligned keyway is disposed within the channel of the second member. The hinge assembly further includes at least two gudgeon clips. The clips have a leg portion and a gudgeon plate portion at right angles to the leg portion, and the leg portion is snugly receivable in the internal keyway. A hinge pin passes through the gudgeon plate and is received in the tube to couple the two members together in hinged relation.

Conveniently, where the hinge assembly is intended for use in a vertical position as is a shower door enclosure, one gudgeon plate locates at the upper extremity of the hinge members, and the other gudgeon plate locates intermediate the axial ends of the members so as to be sandwiched in position. Suitably, this may be effected by cutting a transverse slot through the tube portion of the first member to receive the gudgeon plate therein. A similar transverse slot may also be cut through the bight portion of the second member to connect with the keyway, to permit the leg of the gudgeon clip to be inserted into the keyway. Where this second member is not sufficiently resilient, or as may otherwise be desired, the member may be severed transversely to provide an opening to the keyway. If desired, the first member may be segmented in this manner.

The transverse slots, or the severance of the members, may usually be effected by a simple sawing action. While only two gudgeon clips are referred to above, it will be appreciated that the number and placement of the gudgeon clips is very flexible for manufacturing and other purposes.

Suitably, the bight of the second member is provided with at least one and preferably two rearwardly projecting ears. This second member may be used for both the in-line and the off-set hinges. In the former case, the ear or ears will be proximate the radial wall surface of the tubular wall portion, to form a labyrinth seal therewith. In the off-set type hinge, the ear or ears will abut the bight portion of the second member when the enclosure is closed, to form a labyrinth seal therewith.

Suitably, the outer surface of the bight portion of the second member is outwardly bowed, whereby in the case of the in-line hinge, the bight may be contiguous to the radial surface of the tube portion of the one member and thereby form a seal therewith, or a part of the labyrinth seal.

Conveniently, the hinge pin is continuous so as to pass through each gudgeon plate. Suitably the hinge pin is made from a resilient material whereby it may be deformed by arching or bowing. This permits the hinge pin to be inserted or withdrawn with the panels of the shower door in-situ, to facilitate installation and cleaning or for other maintenance purposes.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
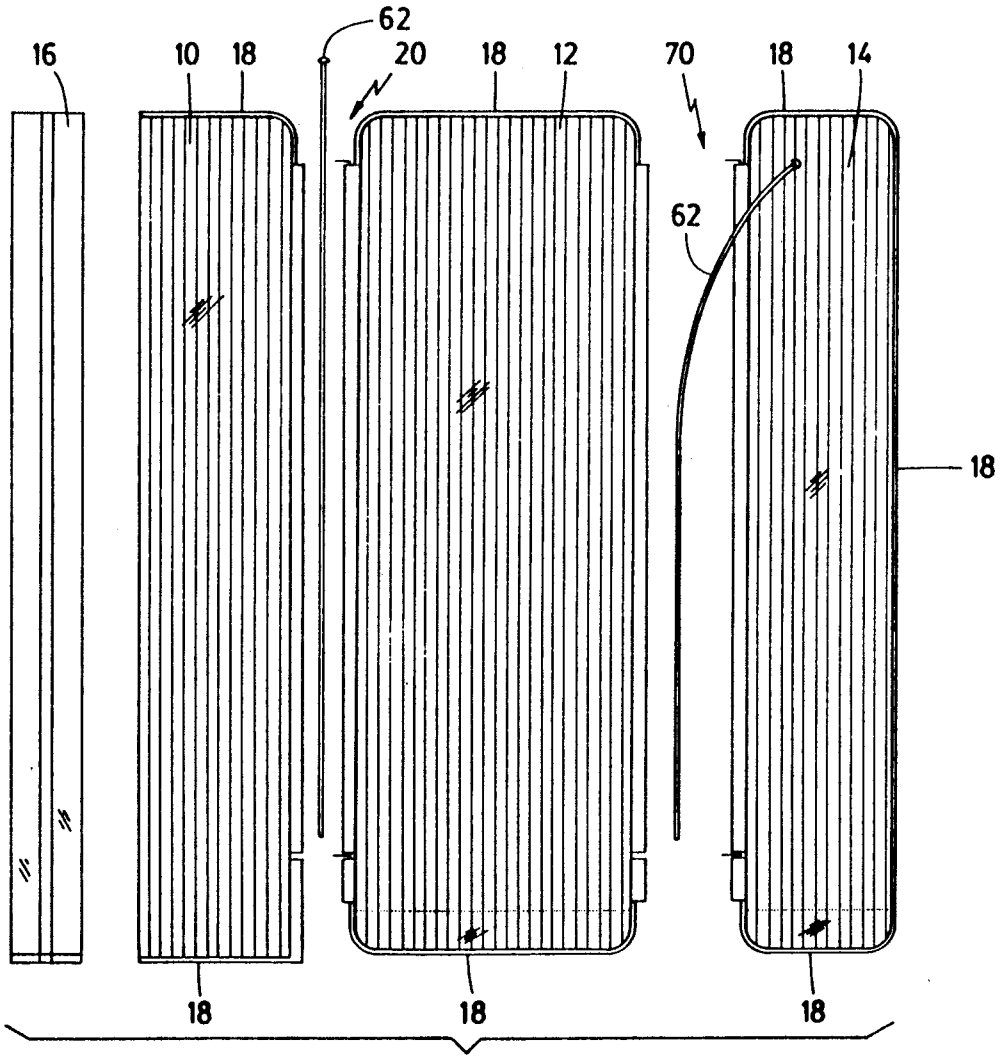
FIG. 1—shows in partly disassembled, front elevation three panels which typically comprise one side of a shower door, the other side thereof being usually the mirror image thereof.

Referring to the drawings in detail, a shower door assembly for a bath or the like is as illustrated in FIG. 1 includes a fixed panel 10, a mid-panel 12 and an end-panel 14. The fixed panel 10 is suitably secured to a wall forming part of a bath enclosure (not shown) by a bracket 16 set forth at greater length in the aforementioned U.S. patent application.

Figure 3:
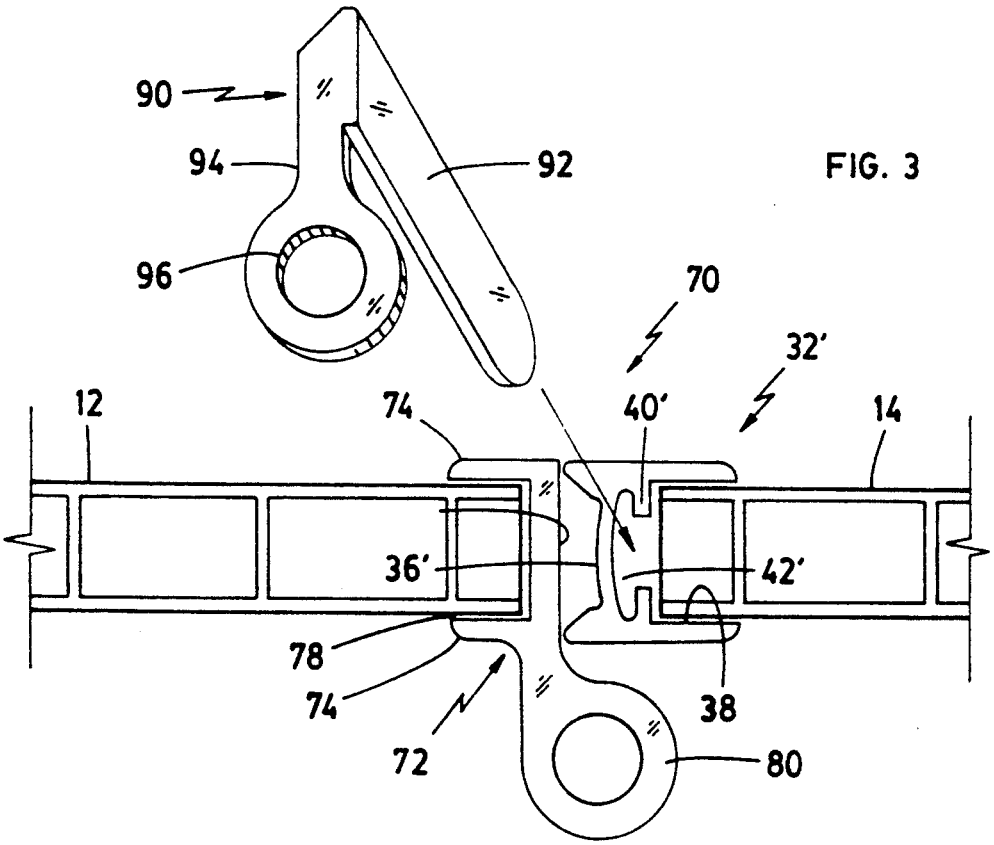

Panels 10, 12 and 14 are each elongated in the vertical direction, and have a hollow fluted structure as seen in FIG. 3. A decorative trim 18 seals upper and lower horizontal marginal portions of panels 10, 12 and 14.

Panels 10 and 12 are joined together by an in-line hinge 20. Hinge 20 comprises a first axially elongated member 22 having a substantially constant cross-section therealong. Member 22 is defined by side walls 24 interconnected by a bight 26 to form a forwardly open channel 28 into which a vertical margin of panel 12 is received in gripping relationship. Member 22 includes an axially aligned tubular portion 30 centrally supported from bight 26. Hinge 20 also comprises a second axially elongated member 32 of substantially constant cross-section, members 22 and 32 conveniently being formed as plastic extrusion moldings. Member 32 is defined by side walls 34 interconnected by bight 36 for form a forwardly open channel 38 in which vertical margin of panel 10 is received. A pair of transverse shoulders 40 depend from side walls 34 inwardly within channel 38 to form an internal keyway 42 associated with the bight 36. A pair of ears 44 project rearwardly from bight 36 on each lateral side thereof, the ears tapering towards the free edge thereof. The outer surface of bight 36 is rearwardly bowed in the transverse direction.

Figure 2:
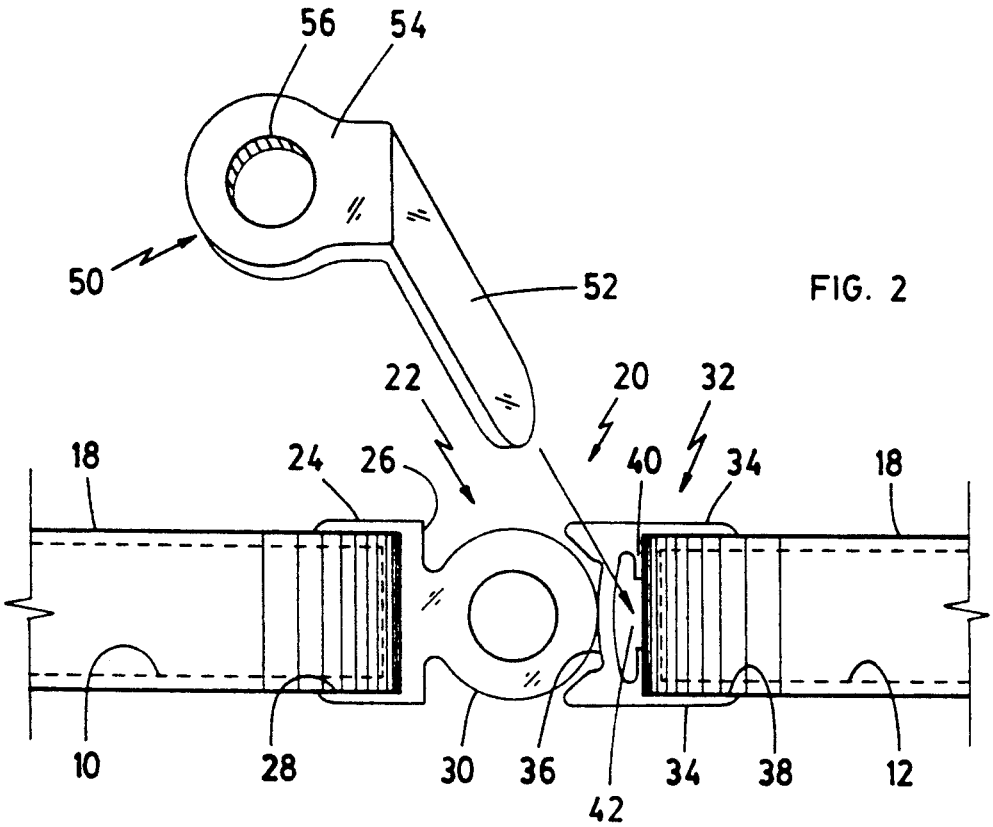
FIG. 2—shows in plan view from above, in exploded form, a fragmentary detail of an in-line hinge assembly used in the door of FIG. 1, and FIG. 3—is similar to FIG. 2 but shows an off-set hinge assembly, with some decorative trim removed.

Hinge 20 further comprises a pair of gudgeon clips 50. Clips 50 include a leg portion 52 which is a snug fit in keyway 42, and a gudgeon plate portion 54 which extends outwardly from the leg portion at right angles thereto. A central opening 56 is provided in gudgeon plate 54. The leg portion 52 of the upper gudgeon clip 50 is inserted into keyway 42 at the upper axial end thereof in the direction of arrow 58, as seen in FIG. 2. A slot 60 is cut transversely through the bight 36 of the second member 32 intermediate the axial ends thereof so as to communicate with keyway 42. The leg portion 52 of the lower of the gudgeon clips 50 is insertable into keyway 42 through slot 60 by the resilient deformation of the wall structure of members 32. As the leg portion 52 is fully inserted in to keyway 42, slot 60 tends to snap behind gudgeon plate portion 54 adjacent its juncture with the leg portion, so providing a bearing surface for supporting the lower gudgeon clip. Optionally, and particularly where member 32 lacks the capability to permit the entry of leg portion 52 into keyway 42 by resilient deformation, slot 60 may be extended rearwardly to detach the lower part of member 32 from the upper part thereof, so as to provide an entry to keyway 42, the two parts then being applied separately to the lateral edge of panel 12.

A slot 60' is cut transversely through tubular portion 30 in opposition to slot 60 to permit the entry of the gudgeon plate portion 54 therein. Hinge assembly 20 is completed with a hinge pin 62 which passes through the openings 56 of the gudgeon plate portions and tubular portion 30 to capture the two members 22, 32 together. When the members are captured in this manner, ears 44 and bight 36 form a labyrinth seal with the radial surface of tubular portion 30. While the seal surfaces are illustrated as being spaced apart, this is for ease of illustration, and the surface may be contiguous if desired, although this will not normally be required for most purposes.

Panels 12 and 14 are joined together by an off-set hinge 70, which comprises a first axially elongated member 72 similar to member 22. This first member 72 includes side walls 74 interconnected by bight 76 to form a forwardly open channel 78 into which a lateral edge of panel 12 is received, and a tubular portion 80 which is carried by bight 76 in laterally off-set relationship. Hinge 70 further includes a second member 32' which is identical to the second member 32 of in-line hinge 20, the elements thereof being differentiated only for the purpose of describing hinge 70 by the addition of a prime mark to the corresponding elements of the second member of hinge 20. First and second members 72,32' are hingedly coupled together with gudgeon clips 90 having leg portions 92 and gudgeon plate portions 94 with an opening 96 therethrough, the method of coupling the members of the off-set hinge assembly being analogous to that earlier described in the case of the in-line hinge 20.

It will be apparent that many changes may be made to the illustrative embodiment, while falling within the scope of the invention and it is intended that all such changes be covered by the claims appended hereto.

I claim:

1. A hinge assembly for joining two panels in hinged relationship comprising:

first and second axially elongated members each having a substantially constant cross-section therealong;

each of said members being defined by axially aligned wall structure including a pair of spaced apart side walls interconnected by a bight together forming a forwardly open channel into which an edge of a panel is receivable;

said wall structure of one of said members further including an axially aligned tube supported from said wall structure defining said channel;

an axially aligned keyway internally disposed within said channel of the other of said members;

at least two gudgeon clips, each having a leg portion receivable in said keyway at axially spaced apart locations therealong and a gudgeon plate portion at right angles to the leg portion, and at least one hinge pin insertable through said gudgeon plate portion into said tube for retaining said first and second members in assembled hinged relationship.

2. A hinge assembly as defined in claim 1, wherein the other of said members is provided with a pair of axially aligned ears respectively located adjacent each said side wall, projecting rearwardly of said bight.

3. A hinge assembly as defined in claim 2, wherein each said ear is tapered towards the free edge thereof.

4. A hinge assembly as defined in claim 2, wherein the outer surface of said bight of the other of said members is rearwardly outwardly bowed in the transverse direction.

5. A hinge assembly as defined in claim 2, wherein said tube is centrally supported from the bight of said one member, and wherein said gudgeon clips are proportioned whereby said ears are proximate the radial wall surface of said tube to form a labyrinth seal therewith when said hinge is assembled.

6. A hinge assembly as defined in claim 5, wherein the radial wall surface of said tube is proximate the outer bowed surface of said bight of the other of said members when said hinge is assembled.

7. A door assembly comprising a pair of panels interconnected by a hinge assembly as defined in claim 2.

8. A door assembly comprising a pair of panels interconnected by a hinge assembly as defined in claim 1.

9. A hinge assembly as defined in claim 1, wherein said tube is provided with at least one transverse slot into which a said gudgeon plate portion is receivable.

10. A hinge assembly as defined in claim 1, wherein said tube is offset to one lateral side of said channel.

11. A hinge assembly as defined in claim 10, wherein said bight of the other said member is provided with a transverse slot in communication with said keyway in opposition to said at least one transverse slot in said tube.

12. A hinge assembly as defined in claim 10, wherein said bight of the other of said members is provided with a pair of axially aligned ears respectively locating adjacent each said side wall, projecting rearwardly of said bight.

13. A hinge assembly as defined in claim 12, wherein said gudgeon clips are proportioned such that when said members are in assembled, closed, relationship said ears abut wall portions of said one member to provide a seal therewith.

14. A hinge assembly as defined in claim 1, wherein said members are retained in assembled relationship by a single hinge pin which extends through each gudgeon plate portion.

15. A hinge assembly as defined in claim 14, wherein said hinge pin is resiliently deformable.

16. A door assembly comprising a pair of panels interconnected by a hinge assembly as defined in claim 15.

17. A shower door assembly comprising at least two panels hingedly connected together by a hinge extending substantially over the length of the door, wherein said hinge comprises:

first and second hinge members substantially coextensive and having substantially constant cross-section therealong;

said first member comprising wall structure defining a channel portion to which an edge of one of said two panel is received, and an axially extending tube portion integrally formed with said channel portion;

said second member comprising wall structure defining a channel, into which an edge of the other of said two panels is received and a keyway contained within said channel;

at least two gudgeon clips, each said clip having a leg portion and a plate portion at right angles thereto having an opening therethrough;

said leg portions being received within said keyway at axially spaced apart intervals, and at least one hinge pin capturing said plate portion of each of said gudgeon clips to said tube portion.

18. The shower door of claim 17, wherein said wall structure defining said channel includes a bight poriton, and wherein an opening is made in said bight portion intermediate the ends of said second member to permit the entry of a leg portion of one of said gudgeon clips into said keyway.

19. The shower door of claim 17, wherein said wall structure defining said channel includes a bight portion and at least one ear projecting outwardly from said bight portion towards said first member to form a seal therewith substantially along the length of said hinge.

20. A shower door comprising three panels connected together with two hinges as defined in claim 17, one of said two hinges having said tube portion thereof centrally located with respect to said channel portion connected thereto, and the other of said two hinges having said tube portion thereof laterally offset with respect to said channel.

* * * * *